United States Patent [19]

McAlpine

[11] 4,404,890

[45] Sep. 20, 1983

[54] FIRE CONTROL SYSTEM

[75] Inventor: Frederick W. McAlpine, Bearsden, Scotland

[73] Assignee: Barr & Stroud Limited, Glasgow, Scotland

[21] Appl. No.: 352,932

[22] Filed: Feb. 26, 1982

Related U.S. Application Data

[63] Continuation of Ser. No. 88,453, Oct. 22, 1978, abandoned.

[30] Foreign Application Priority Data

Nov. 2, 1978 [GB] United Kingdom ..... 43015/78

[51] Int. Cl.[3] ..... F41G 3/06

[52] U.S. Cl. ..... 89/41 E; 89/41 L; 356/252

[58] Field of Search ..... 33/238, 239; 89/41 E, 89/41 EA, 41 AA, 41 L; 356/29, 252

[56] References Cited

U.S. PATENT DOCUMENTS

| | | | |
|---|---|---|---|
| 2,539,501 | 1/1951 | Weiss | 33/238 |
| 3,059,338 | 10/1962 | Coeytaux | 89/41 E |
| 3,960,453 | 6/1976 | Svensson et al. | 356/252 |
| 3,997,762 | 12/1976 | Ritchie et al. | 89/41 E |

FOREIGN PATENT DOCUMENTS 1230413 9/1960 France .

OTHER PUBLICATIONS

Hausmann et al., Physics, 1939, pp. 38–39.

*Primary Examiner*—Stephen C. Bentley
*Attorney, Agent, or Firm*—Mason, Fenwick & Lawrence

[57] ABSTRACT

A fire control system for a gun comprises a means 10 for determining the position of a target, computer 14 which receives signals representative of the target position from the means 10 and computes fire control signals according to a known programme, the fire control signals being transmitted to a gun drive mechanism 16. The means 10 includes an optical sighting device 11 containing a visual display 30 on which two images are presented in superimposition. One of the images is of the field of view containing the target while the other image is a pattern of predetermined character which is controllably movable over the visual display by adjustment devices 32A, 32B under control of the operator. The means 10 further includes a ranging device 12 and a manually controllable element 21 for altering the field of view. The arrangement is such that a target is located within the field of view as a result of adjustment of the element 21 for altering the field of view. Subsequent movement of the target is then determined by operator operation of the manually adjustable means 32A, 32B so that the direction and rate of movement of the pattern image on the visual display is synchronised in direction and speed with that of the target, the status of the manually adjustable means 32A, 32B being fed to the computer 14.

1 Claim, 4 Drawing Figures

FIRE CONTROL SYSTEM

This is a continuation of application Ser. No. 88,453, filed Oct. 22, 1978 now abandoned.

This invention relates to a fire control system for a gun.

Various forms of fire control systems for a gun are already known in each of which there is a sighting device with a visual display on which an operator observes a field of view. The sighting device and the operator are housed in a rotatable enclosure or cupola and in order to vary the field of view in azimuth the entire cupola and sighting device are rotated. The cupola has a considerable inertia which complicates the operations required of an operator when a moving target is sighted within the field of view because it is a requirement of the computer programme governing the positioning of the gun that the direction and speed of movement of the target be estimated prior to the gun being moved to its firing position and this estimation is conventionally undertaken by the operator tracking the moving target so that the target image on the visual display is held at a fixed location (e.g. at the centre of the display).

According to the present invention there is provided a fire control system for a gun comprising target position determining means, a computer adapted to receive signals representative of ballistic parameters and to receive from said position determining means signals representative of target position and arranged to compute fire control signals therefrom, a gun drive mechanism coupled to receive said fire control signals from said computer, wherein said target position determining means includes a sighting device having a visual display on which first and second images are presented in superimposition, said first image being a field of view and said second image being a two-dimensional pattern of predetermined character controllably movable in a substantially continuous manner, in at least one dimension over said visual display, said target position determining means further including a device for determining the range of a target in said field of view and a manually-controllable element for altering said field of view, said sighting device further including manually-adjustable means for controlling the speed of movement of said second image over said visual display and a connection between the manually-adjustable means and the computer.

the arrangement being such that, in operation, a moving target in said field of view has its range determined by the ranging device, and its direction and speed of movement determined by synchronising therewith the movement of the second image through adjustment of said manually-adjustable means.

An embodiment of the present invention will now be described by way of example with reference to the accompanying drawings, in which.

Figures 1, 2:
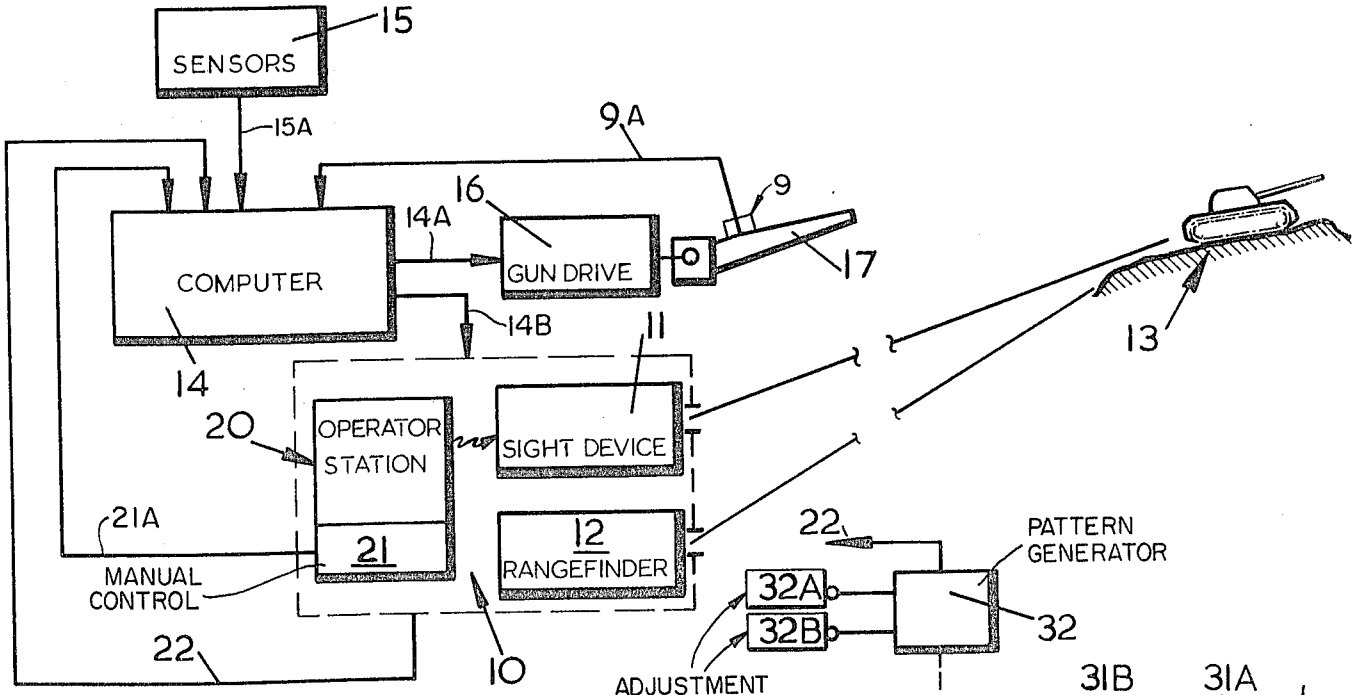
FIG. 1 is a block diagram showing the general organisation of a fire control system.
FIG. 2 illustrates the sighting device of FIG. 1 in greater detail.

In the fire control system of FIG. 1 there is a target position determining means or monitoring station 10 which incorporates a sighting device 11 and a ranging device 12 in the form of a laser rangefinder both of which are mounted in a gun cupola (not shown) and arranged to survey a target scene 13. A computer 14 receives on line 15A input signals representative of environmental parameters such as air temperature, barometric pressure, wind direction and velocity, compass heading and gravity from sensors 15. Signals representative of ballistic parameters such as charge temperature, type of ammunition selected and gun barrel bending are fed from sensors 9 along line 9A to the computer 14 which in accordance with a predetermined programme computes fire control signals and in one embodiment applies these signals, via line 14A, to a drive mechanism 16 for a gun 17. The programming of the computer (either analogue or digital or hybrid) may be in accordance with the equations of motion derived in the book 'New Methods in Exterior Ballistics' by F. R. Moulton. One particular form of such a computer is described in U.K. Patent Specification No. 1,285,722.

The sighting device 11 includes a visual display 40 (FIG. 3) which will be described in detail hereinafter and which is witnessed by an operator at a station 20 where a manually controllable element 21 is provided which when actuated causes alteration of the field of view of the sighting device 11 the extent of which alteration is notified to computer 14 along line 21A. The means 10 is also coupled by a link 22 to the computer 14 in order to provide signals representative of target-dependent parameters.

The sighting device 11 is shown in greater detail in FIG. 2 and comprises an eyepiece 30 with optical components 31A, 31B, 31C which direct light from the target scene 13 along a sight line 30A to the eyepiece 30 at which the visual display 40 is formed. Component 31C is in the form of a partially reflecting planar mirror and permits a patterned image generated in a pattern generator 32 to be injected into the line of sight 30A and viewed, by an operator, in super imposition with the target scene.

Figure 3:
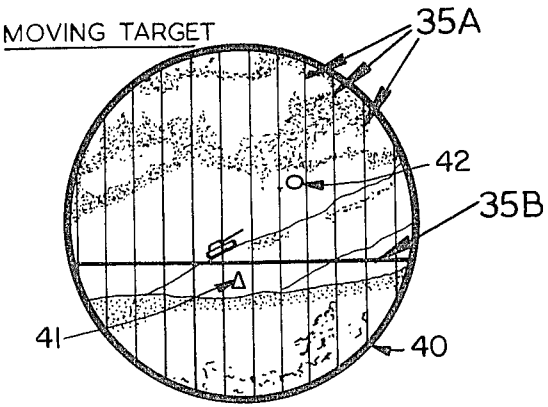
FIG. 3 is useful in understanding the operation of the present invention.

A typical visual display 40 as viewed by an operator at eyepiece 30 is illustrated in FIG. 3 and comprises an image of the target scene 13 in super-imposition with a pattern in the form of a set of vertical lines 35A and a horizontal line 35B.

The pattern generator 32 has a first manual adjustment device 32A which is operable to effect an apparent lateral movement of the lines 35A, and a second manual adjustment device 32B which is operable to effect an angular tilt of the line 35B. In this pattern the lines 35A remain orthogonal to line 35B independently of the angular tilt of line 35B. The adjustment devices 32A,32B within generator 32 also feed link 22 of FIG. 1.

In operation of the fire control system of the present invention the operator searches for a target by initially moving in azimuth the gun cupola and the sighting device 11 by operation of element 21, the latter being independently movable in elevation, and when the operator sights a target by means of the sighting device 11 these movements are terminated and any subsequent movement of the target across the visual display is tracked by means of adjustment (by the operator) of the devices 32A, 32B to produce a pattern of the format described in which line 35B is aligned with the direction of movement of the target and lines 35A are given a movement (rear or apparent) synchronised with the rate of travel of the target. The settings of devices 32A, 32B required to achieve this pattern condition are supplied to link 22 for eventual feeding to computer 14 and permit the computer to calculate the required gun lead angle. The operator then manually drives the gun and sighting device, using device 21, so that the mean bore sight mark (MBS) 41 is centered on the target, takes the target range by actuating the rangefinder 12 and automatically on ranging the range signal and the settings of devices 32A, 32B are fed to computer 14 along link 22 to produce an aiming mark 42 on the display 40. This aiming mark 42, conveniently, may be the conventional ellipse shape, the size of which is determined by the range of the target. In the first embodiment the fire control signals from the computer 14 on line 14A actuate mechanism 16 to drive the gun 17 so that the aiming mark 42 is hopefully aligned with the target and this is simply monitored by the operator but in a second embodiment the fire control signals are not sent by the computer 14 to the mechanism 16, instead are sent only to the sighting device 11 on line 14B and the operator thereafter manually lays this ellipse aiming mark 42 on the target by operation of device 21 and then fires gun 17.

By virtue of the fire control system of the present invention target speed and direction are measured without any requirement to move the gun cupola after the target has been sighted which is a significant advantage having regard to the considerable inertia thereof.

Conveniently, when the elliptical aiming mark 42 is injected into the field of view the pattern 35, 35B produced by generator 32 is blanked out by a signal from computer 14.

The pattern which forms the second image on the visual display is preferably as described above but may be in the form of a matrix of orthogonal lines each set moving in the manner described with reference to FIG. 3.

The pattern generator may take any one of several forms. For example the pattern may be generated by a liquid crystal or light emitting diode (LED) matrix. Alternatively it may include a CRT with spot deflection control circuits. The pattern shown in FIG. 3 in which the lines 35A appear to move across the display screen in either direction at a selectable rate may be determined by the degree of mismatch of the Y-deflection drive frequency with the X-deflection drive frequency, the line 35B being drawn in response to a bright-up pulse applied during the X-deflection flyback period. Adjustment device 32A will therefore control the frequency of either the X or Y deflection drive signal. In order to tilt the pattern of FIG. 3 through a predetermined angle adjustment device 32B may be in the form of a sinusoidally wound potentiometer 46 coupled to two mixing circuits 47, 48 each of which receives the X and Y deflection drive signals (from generators 49, 50) and having outputs 47A, 48A respectively coupled to the X and Y deflection drive circuits (51, 52).

If the line 35B is tilted through $\theta$ degrees and the X-deflection drive signal at generator 49 is X'and the Y-deflection drive signal at generator 50 is Y'. then the signal applied to the X-deflection coil 51 is $$X' \cos \theta - Y' \sin \theta$$

and the signal applied to the Y-deflection coil 52 is $$Y' \cos \theta + X' \sin \theta$$

Figure 4:
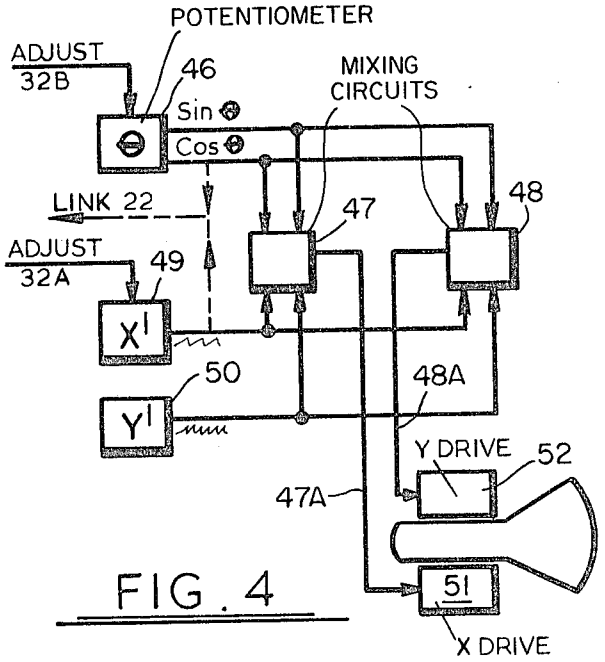
FIG. 4 illustrates one emodiment of sighting device.

Such an arrangement is shown in schematic form in FIG. 4.

A CRT pattern generator is particularly useful in that the pattern shape can be varied easily and the pattern can be generated at a high rate (for example 160 frames/sec) with successive frames very close so that the same line of successive frames is spaced from its previous position by as little as 0.1 mm whereby the pattern appears to move in a steady manner across the field of view. This facilitates tracking of targets moving with angular velocities in the range 0.0001 radians/sec to 0.1 radians/sec. Also a CRT pattern generator permits the pattern to be orientated to any angle to the horizontal without any need for mechanical or optical adjustments. Furthermore, where an elliptical aiming mark 42 is used the same CRT pattern generator 32 can be used for the aiming mark 42 and for the moving pattern (35A, 35B) either on an interlaced frame basis so that both are visible simultaneously or on a time shared basis. This latter arrangement is particularly useful in that the CRT 32 can be arranged to lay down the moving pattern (35A, 35B) so that the entire visual display 40 is covered by the pattern and when the target is first located in the visual display the direction and speed of movement can be determined as previously described prior to the target being centralised in the field of view at the MBS mark 41. When the target is so centralized the pattern 35A, 35B can be finally adjusted to its precise setting and the CRT 32 actuated to lay down the aiming mark 42 thereafter. This is advantageous because the synchronisation of the moving pattern 35A, 35B with the moving target is much more time consuming than is target ranging with the laser rangefinder 12 the range signal of which automatically causes the computer 14 toproduce the aiming mark 42 on the CRT display 40.

What is claimed is:

1. A fire control system for a gun, comprising a gun drive mechanism;

a sighting device having a ballistic aiming mark;

a ballistic computer arranged to compute fire control signals from parameter-dependent input signals;

sensor means for establishing individual electrical input signals from respective environmental and ballistic parameters;

operator-actuated means associated with said sighting device for establishing individual electrical input signals from respective target-dependent parameters; and means for applying the input signals established by said sensor means and said operator-actuated means to said computer;

wherein said sighting device comprises a visual display on which a sighting mark and first and second images are presented in superimposition, said first image being from a field of view and said second image being from a dual-mode electronic pattern generator which when operable in one of said modes establishes said ballistic aiming mark; said electronic pattern generator when operable in the other of said modes establishing a predetermined pattern in the form of a set of parallel lines arranged to move as a body substantially continuously over said visual display in the direction of an orthogonal line;

and said operator-actuated means comprises manually-actuable means for altering the field of view of said sighting device; rate means operable by a single operator-actuated rate controller for setting the rate of movement of said set of lines on said visual display; orientation means operable by a single operator-actuated orientation controller for setting the orientation of the orthogonal line on said visual display; and a laser rangefinder device for determining the range of a target in said field of view with said sighting mark aligned thereon;

the arrangement being such that, in operation, a moving target has its direction of movement parameter determined by the orientation controller when said orthogonal line is aligned on the visual display with the target movement direction and its rate of movement parameter determined by the rate controller when said set of lines move over the visual display in synchronism with the target movement, the field of view being held stationary during determination of said movement parameters, the range parameter being subsequently determined by the rangefinder device after alteration of the field of view so that the sighting mark is aligned with the target, said range, rate and direction parameters being determined independently of each other during operation of the pattern generator in said other mode and establishing individual electrical input signals for said ballistic computer, said computer having means to cause said pattern generator to establish said ballistic aiming mark on the visual display for positioning by the fire control signals on receipt of the range parameter input signal, the gun drive mechanism being thereafter actuated to align the aiming mark on the target prior to firing of the gun.

* * * * *